US005893512A

United States Patent [19]

Diedrich

[11] Patent Number: 5,893,512

[45] Date of Patent: Apr. 13, 1999

[54] PRESSURE SEAL FORM/LABEL COMBINATION

[75] Inventor: Sherry Diedrich, Minnetonka, Minn.

[73] Assignee: Moore U.S.A Inc., Grand Island, N.Y.

[21] Appl. No.: 08/935,770

[22] Filed: Sep. 23, 1997

[51] Int. Cl.[6] ..... B65D 27/00

[52] U.S. Cl. ..... 229/92.1; 229/74; 229/300

[58] Field of Search ..... 229/92, 92.1, 74, 229/300, 305

[56] References Cited

U.S. PATENT DOCUMENTS

| | | | |
|---|---|---|---|
| 2,967,657 | 1/1961 | Kushner . | |
| 4,579,277 | 4/1986 | Gendron . | |
| 4,928,875 | 5/1990 | Hutchinson . | |
| 5,031,382 | 7/1991 | Boyle . | |
| 5,174,493 | 12/1992 | File . | |
| 5,183,203 | 2/1993 | Sanders . | |
| 5,193,850 | 3/1993 | Lombardo . | |
| 5,201,464 | 4/1993 | File . | |
| 5,207,373 | 5/1993 | Tighe . | |
| 5,253,798 | 10/1993 | Lombardo et al. . | |
| 5,289,972 | 3/1994 | Sauerwine et al. . | |
| 5,294,041 | 3/1994 | Whiteside . | |
| 5,318,324 | 6/1994 | Lombardo et al. . | |
| 5,370,302 | 12/1994 | Dyer . | |
| 5,372,302 | 12/1994 | Loch et al. | 229/92.1 X |
| 5,376,048 | 12/1994 | Whiteside . | |
| 5,397,052 | 3/1995 | Walz . | |
| 5,427,832 | 6/1995 | Longtin . | |
| 5,642,855 | 7/1997 | Michlin . | |
| 5,705,243 | 1/1998 | Mehta et al. | 229/92.1 X |

FOREIGN PATENT DOCUMENTS

| | | | |
|---|---|---|---|
| 5112363 | 5/1993 | Japan | 229/92.1 |

*Primary Examiner*—Jes F. Pascua
*Attorney, Agent, or Firm*—Nixon & Vanderhye, P.C.

[57] ABSTRACT

An eccentric Z-fold mailer intermediate, and mailer produced from the intermediate, offers a significant saving in mailing a customer merchandise return mailer. A sheet of paper (typically 8 ½×14 inches) has first and second fold lines parallel to the top and bottom edges and dividing the sheet into first through third panels, the second and third panels of substantially the same size and shape (e.g. and a length of about 5.75 inches), and the first panel of a smaller length (e.g. about 2.5 inches). A blow on mailing label assembly, including a release liner adhesively attached to the sheet and a merchandise return label including merchandise label return tracking indicia is adhesively secured to the release liner, is provided on the first face of the third panel. A series of patterns of pressure activated cohesive, e.g. disposed in separable margin strips, hold the mailer panels together in a Z-fold configuration, with outgoing address indicia on the first face of the first panel.

20 Claims, 3 Drawing Sheets

PRESSURE SEAL FORM/LABEL COMBINATION

BACKGROUND AND SUMMARY OF THE INVENTION

There are many marketers of products, particularly catalog companies, that receive requests from customers to return merchandise. The United Parcel Service (UPS) has approved a particular label for that purpose, called an Authorized Return Service label (ARS). Such a label is used for postage paid return of merchandise. In conventional techniques practiced by most catalog companies, and others dealing with return merchandise, a conventional UPS/ARS label (comprising a label that is about 4.5×5.75 inches having pressure sensitive adhesive on one face thereof and UPS Groundtrac information, including tracking numbers, on the other face thereof, and the adhesive attached to a conventional release liner) is inserted into a No. 10 envelope with a letter from the catalog company or the like, and mailed to the customer. When a customer receives the envelope, he or she opens it up, reads the letter, removes the merchandise return label (ARS label) from the release liner backing, and places them on a package containing the merchandise to be returned. This is a labor intensive process which costs more, and takes more time, than is desired.

According to the present invention, the cost and time associated with sending out ARS labels are both greatly reduced by incorporating the ARS label as part of any an eccentric Z-fold mailer, formed of a single sheet of paper (typically an 8 ½×14 inch sheet). The invention allows 2 the outgoing address and the letter from the catalog company to be simplex printed at the same time, allows the ARS label to be affixed to the same face of the mailer on which simplex printing is provided, and allows the mailer to be readily sealed (so that the label is within a completely sealed compartment) by machine and mailed out. Utilizing the intermediate in the mailer according to the present invention, the savings of more than a dollar and twenty-five cents per document can be achieved compared to the prior art process described above, with an increased customer satisfaction and less turn around time for sending out an ARS label from the time that it is requested.

According to one aspect of the present invention an eccentric Z-fold mailer intermediate is provided comprising the following components: A quadrate sheet of paper having first and second faces, top and bottom substantially parallel edges, and substantially parallel side edges substantially perpendicular to the top and bottom edges. First and second fold lines substantially parallel to the top and bottom edges, and dividing the sheet of paper into first, second, and third panels, the first panel between the top edge and the first fold line, and the third panel between the bottom edge and the second fold line, and the second panel between the first and second panels, the second and third panels of substantially the same size and shape, and the first panel having a smaller length, along the side edges, than the second and third panels. A blow on shipping (e.g. mailing) label assembly disposed on the first face of the third panel. A first series of patterns of adhesive disposed on the first face of the second and third panels for holding the first face of the second and third panels together when the sheet is folded about the second fold line. And a second series of patterns of adhesive disposed on the second face of the first and second panels for holding the second face of the first and second panels together when the sheet is folded about the first fold line.

The blow on label assembly preferably comprises a release liner permanently adhesively attached (over substantially the entire surface thereof) to the sheet, and a merchandise return label including UPS Groundtrac information (that is an ARS label) on a first face thereof, and pressure sensitive adhesive on a second face thereof releasably attached to the release liner. Outgoing address indicia is imaged on the first face of the first panel, and other indicia (typically a "letter" from the mailer, such as a catalog company) imaged on the first face of the second panel, the other indicia and the outgoing address indicia having the same orientation, formed by simplex printing of the first face of the intermediate.

The intermediate preferably further comprises first and second lines of weakness parallel to and adjacent the side edges to define separable edge strips of the sheet, portions of the first and second series of the patterns of adhesive disposed in the separable margin strips. The first and second patterns of adhesive preferably comprise pressure activated cohesive. The intermediate also preferably comprises third and fourth lines of weakness parallel to and adjacent the bottom edge and the first fold line in the second panel, portions of the first pattern of adhesive disposed on the first face between the bottom edge and the third line of weakness, and between the first fold line and the third fold line.

Also, return address indicia is imaged on the second face of the second panel adjacent the second fold line and has the same orientation as the outgoing address indicia wherein the first panel is folded about the first fold line. The quadrate sheet preferably has side edges having a length of about 14 inches, and the sheet top and bottom edges have a length of about 8.5 inches, and the first panel side edges have a length of about three inches. The merchandise return label (as is conventional) typically has dimensions of about 4.25 by 5.75 inches. The merchandise return label also is spaced at least about 0.75 inches from each of the bottom edge and the second fold line.

According to another aspect of the present invention an eccentric Z-fold mailer is provided, comprising the following features: First, second, and third panels each having first and second faces, and disposed in a stack, the second panel sandwiched between the first and third panels so that the second face of the first panel engages the second face of the second panel, and the first face of the second panel engages the first face of the third panel. The second and third panels have substantially the same size and shape, including aligned side edges have a first length. The first panel has a second length significantly less than the first length. Outgoing address indicia is imaged on the first face of the first panel and other indicia is imaged on the first face of at least one of the second and third panels. A blow on label assembly is sandwiched between the second and third panels. And adhesive patterns connect the second and third panel first faces together, and the second faces of the first and second panels together.

The adhesive patterns preferably comprise pressure activated cohesive. The blow on label assembly is preferably as described above, with the release liner pressure sensitive adhesive attached to the third panel first face and the other indicia on the second panel first face. The second and third panels have side edges with a length of about 5.75 inches, and the first panel has side edges with a length of about 2.5 inches. Lines of weakness are provided in the panels adjacent but spaced from the side edges thereof, and pressure activated cohesive is disposed between the lines of weakness and side edges.

It is a primary object of the present invention to provide for the cost effective and quick production and mailing of mailers with merchandise return labels. This and other objects of the invention will become clear from an inspection of the detailed description of the invention and from the appended claims.

DETAILED DESCRIPTION OF THE DRAWINGS

Figure 1:
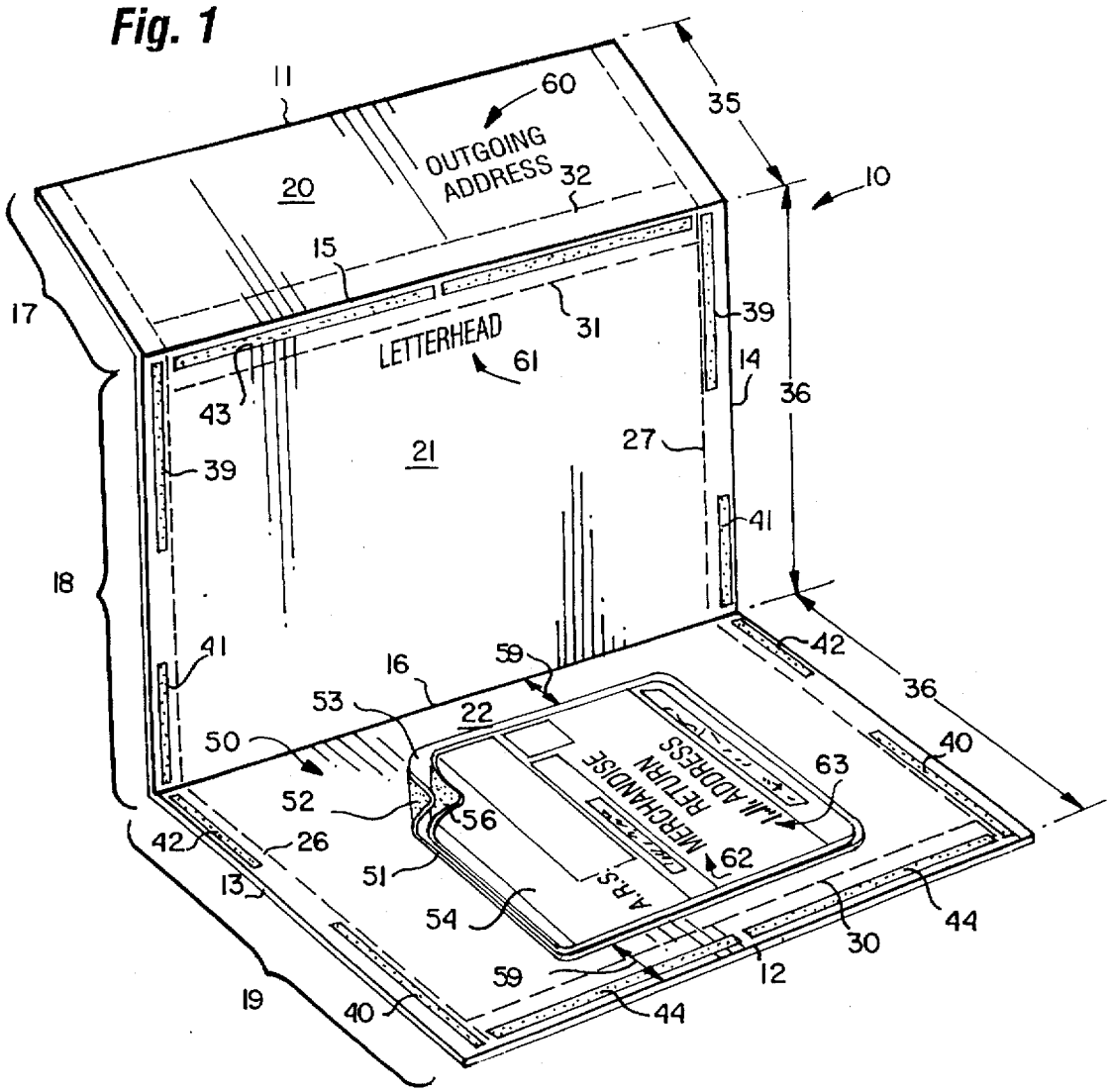
FIG. 1 is a top plan view of a first face of an intermediate according to the present invention.
Figure 2:
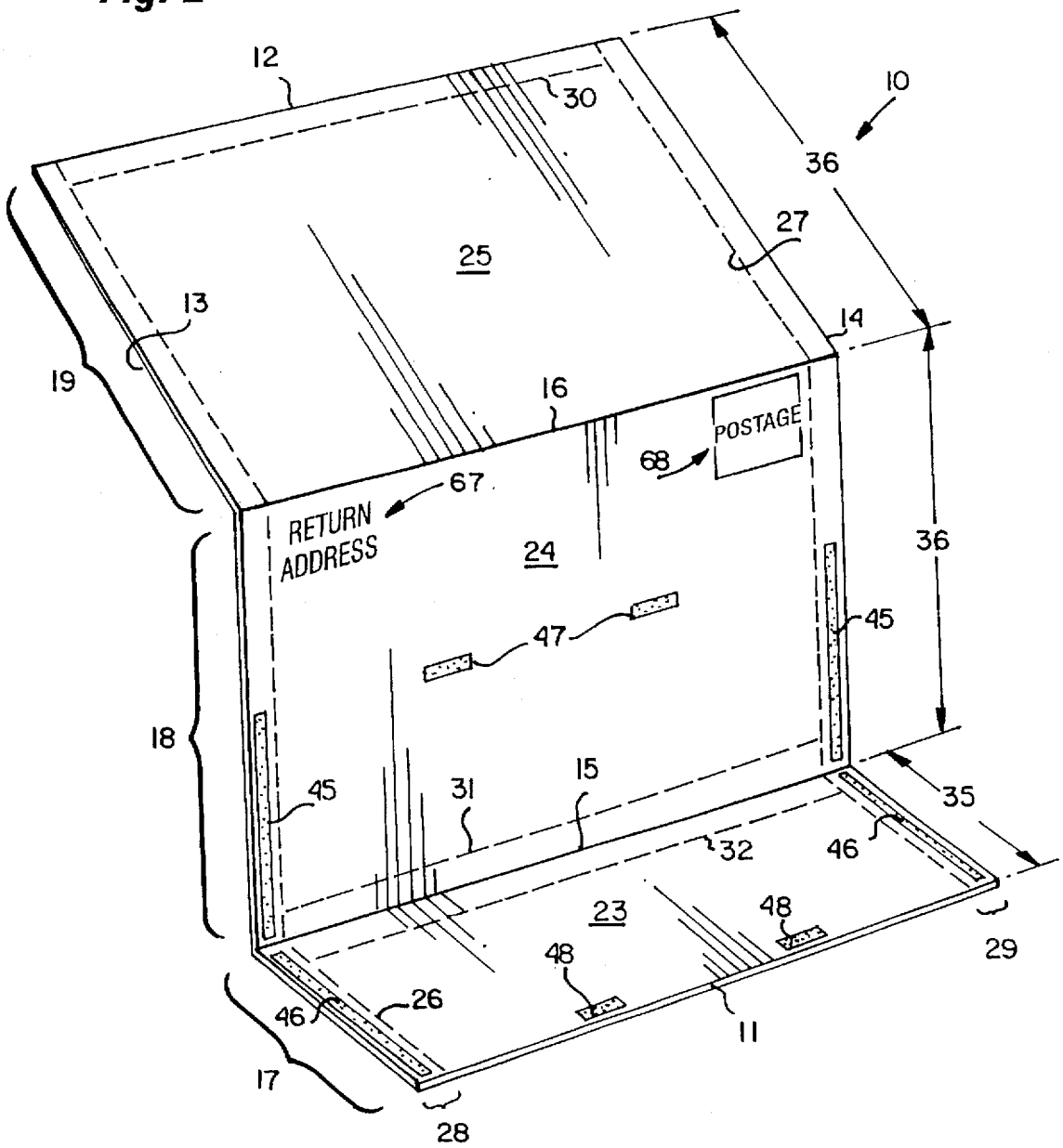
FIG. 2 is a bottom view of the intermediate of FIG. 1.

An intermediate for an eccentric Z-fold mailer, which comprises a quadrate single sheet of paper, is shown generally by reference numeral 10 in FIGS. 1 and 2. In the preferred embodiment according to the invention the sheet of paper 10 has dimensions of about 8 ½ inches by 14 inches, although for some circumstances the dimensions may be revised (including 8 ½×13 inch, A4 and 8 ½×11 inch sheets). The sheet 10 has top and bottom edges 11, 12, respectively, which are substantially parallel to each other, and side edges 13, 14 which are substantially parallel to each other and substantially perpendicular to the top and bottom edges 11, 12. The sheet 10 also has first and second fold lines 15, 16 which are substantially parallel to each other and the top and bottom edges 11, 12. The fold lines 15, 16 may be made by any suitable technique, such as creasing, scoring, providing lines of weakness (such as perforation lines), or the like. The fold lines 15, 16 divide the sheet 10 into first, second and third panels 17, 18, 19, respectively, the panels 18, 19 having substantially identical size and shape while the panel 17 has a length significantly less than the panels 15, 19. The sheet 10 also has a first face—which comprises the portions 20–22, respectively, for each of the panels 17–19 (see FIG. 1), and a second face which comprises the portions 23–25 for the panels 17 through 19, respectively (see FIG. 2).

The intermediate 10 also preferably has first and second lines of weakness 26, 27 which are adjacent, substantially parallel to, but spaced from the side edges 13, 14, respectively, defining separable margin strips 28, 29 (see FIG. 2). The lines of weakness 26, 27 preferably are perforation lines. Also, preferably third and fourth lines of weakness 30, 31, are provided adjacent, parallel to, but spaced from the bottom edge 12 and the first fold line 15 on the second panel 18, as seen in FIGS. 1 and 2, and a fifth line of weakness 32 may also be provided disposed on the opposite side of the first fold line 15 from the fourth line of weakness 31 and spaced the same distance from the fold line 15. The lines of weakness 30–32 also preferably are perforation lines. All of the perforation lines allow quick opening of the mailer formed from the sheet 10.

The length (along the side edges 13, 14) of the first panel 17 is denoted by the dimension 35 in FIGS. 1 and 2, and in the preferred embodiment is preferably about 2.5 inches (e.g. about 2.5–3 inches). The lengths of the second and third panels 18, 19 are both indicated by the reference numeral 36 in FIGS. 1 and 2, and in the preferred embodiment of the invention the length 36 is about 5.75 inches (e.g. about 5.5–5.75 inches).

The intermediate 10 also comprises a first series of patterns of adhesive disposed on the first faces 21, 22 of the second and third panels 18, 19 in the separable margins 28, 29 and in the strips between the bottom edge 12 and the third line of weakness 30, and the first fold line 15 and the fourth line of weakness 31. In the embodiment illustrated in FIG. 1, these patterns of adhesive comprise the strips 39 on the face 21 which cooperate with the strips 40 on the face 22, the strips 41 on the face 21 which cooperate with the strips 42 on the face 22, and the strips 43 on the face 21 which cooperate with the strips 44 on the face 22. Other patterns besides strips, such as closely spaced dots, wavy lines, or the like, also may be provided as long as they provide effective sealing.

All of the patterns 39–44 preferably comprise pressure activated/sensivated cohesive. The pressure activated cohesive used in the intermediate/mailer according to the present invention is conventional per se. Preferably it comprises a styrene-natural rubber copolymer, as disclosed in U.S. Pat. No. 4,918,128. The pressure activated cohesive, in various trade available forms thereof, and patents showing the same, are disclosed in U.S. Pat. No. 5,201,464 (the disclosure of which is hereby incorporated by reference herein), and updated commercial versions may also be utilized, such as TN-124F, available from TOPPAN Printing Company of Japan.

The intermediate 10 also comprises a second series of patterns of adhesive disposed on the second faces 23, 24 of the first and second panels 17, 18, as illustrated in FIG. 2. A second series of patterns in the embodiment illustrated in FIG. 2 comprises the strips 45 on the face 24 cooperating with the strips 46 on the face 23, and the "tacking" blocks 47 on the face 24 cooperating with the comparable blocks 48 on the face 23. The second series of patterns 45–48 also preferably comprises a pressure activated cohesive such as described above.

The intermediate 10 also includes a blow on shipping (mailing) label assembly 50 which may be disposed on either the faces 21, 22, but preferably is on the face 22. The assembly 50, which is applied using conventional blow on label equipment, preferably comprises a release liner which is affixed to the face 22 by permanent pressure sensitive adhesive 52. The adhesive 52 is preferably disposed over substantially the entire bottom face of the release liner 51 so that all portions of the release liner 51 are positively secured to the face 22. On the face of the release liner 51 opposite the adhesive 52 is a conventional release material 53 (e.g. silicone), which will readily release the pressure sensitive adhesive. The assembly 50 further comprises a UPS/ARS merchandise return label 54 having a first face 55, which is the top face thereof, and a bottom face having pressure sensitive adhesive 56 disposed over substantially the entire surface thereof. The adhesive 56 lightly adheres to the release liner 53 but may be readily separated for use of the label 54.

The label 54 preferably has the dimensions of a conventional ARS label, which presently is about 4.25 inches by 5.75 inches. The size of the release liner 51 is preferably slightly greater than the size of the label 54 and is provided around all four peripheral portions of the label, typically a sixteenth of an inch greater all around. In order to effectively use commercial blow on label equipment, the top and bottom edges of the label 54 are spaced from the bottom edge 12 and the fold line 16 a preferably uniform distance 59 (see FIG. 1) of at least about 0.75 inches.

Various indicia are also associated with the intermediate 10. For example, outgoing address indicia 60 is imaged on the face 20, while other indicia 61, which typically includes the letterhead of the sending company and other indicia about how merchandise may be returned, soliciting other sales, or the like, is provided on the face 21. The indicia 60, 61 have the same orientation and are preferably simplex printed at the same time when the intermediate 10 is passed through a simplex printer (such as a conventional laser printer).

The face 55 of the label 54 has merchandise return tracking indicia 62, 63, which can provide a return address in both human readable and machine readable form, and other indicia may be provided as is conventional for an ARS label, such as the customer information, return to address, a bar code number, and the like.

Indicia is also preferably provided on the face 24 (see FIG. 2) in the form of return address indicia 67 and indicia 68 either indicating postage, or postage is to be applied. The indicia 67, 68 is preferably preprinted on the intermediate 10 before being used by the customer to pass through a simplex printer for the application of the indicia 60, 61. The indicia 62–63 is also preprinted before application to the intermediate 10. The indicia 67, 68 has the same orientation as the indicia 60 when the intermediate 10 is folded about the fold lines 15, 16 to form the mailer 70 illustrated in FIG. 3.

Figure 3:
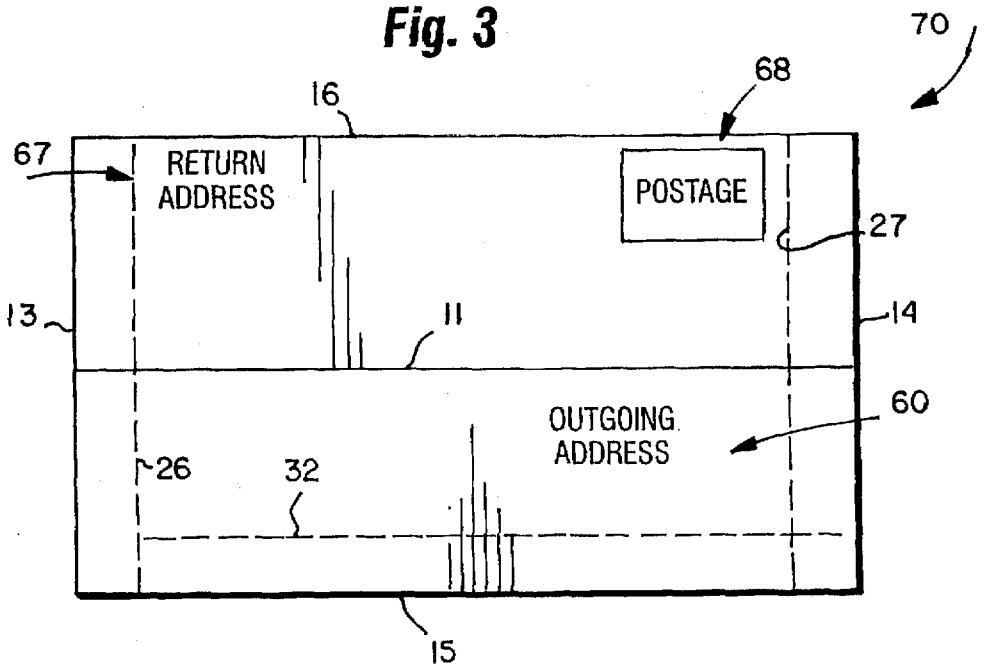
FIG. 3 is a top plan view of an eccentric Z-fold mailer according to the present invention produced from the intermediate of FIGS. 1 and 2.
Figure 4:
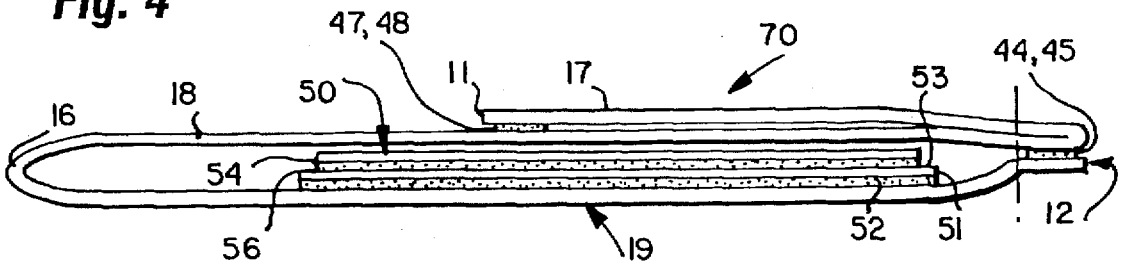
FIG. 4 is a side view, with the edge margins removed for clarity of illustration, and with the components greatly exaggerated in size for clarity of illustration, of the mailer of FIG. 3.

By eccentrically Z-folding, typically using conventional folding equipment, the intermediate 10 about the fold lines 15, 16, the eccentric Z-fold mailer 70 of FIGS. 3 and 4 is produced. The pressure activated cohesive pattern 39–48 are typically all activated at the same time (usually in either one or two passes) by passage through conventional sealing equipment, such as sold by Moore USA, Inc. of Lake Forest, Ill. under the trademark SPEEDISEALER®, and such as shown in U.S. Pat. Nos. 5,397,427, 5,183,527, 5,169,489, 5,133,828, and 5,378,303. Other conventional equipment can also be used just so sufficient pressure (typically on the order of about: 100 lbs. per lineal inch, or more) is applied to the mailer 70 so that the cohesive patterns 39–48 thereof are pressed into permanent engagement with each other.

The mailer 70 has the first, second and third panels 17, 18, and 19 disposed in a stack as illustrated in FIG. 4 and is discernible from FIG. 3, with the second panel 18 sandwiched between the first and third panels 17, 19 so that the second face 23 of the first panel 17 engages the second face 24 of the second panel 18, and the first face 21 of the second panel 18 engages the first face 22 (and label assembly 50) of the third panel 19. The cohesive patterns 39, 40; 41, 42; 43, 44; 45, 46; 47, 48, cooperate to hold the mailer 70 in the position illustrated in FIG. 4.

Figure 5:
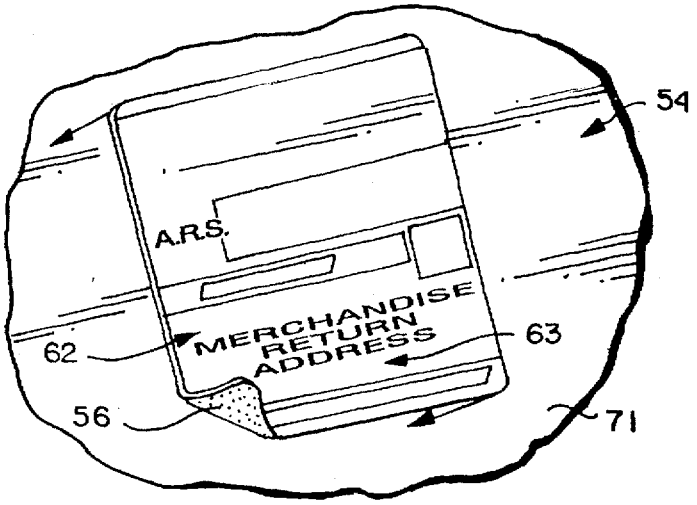
FIG. 5 illustrates the use of the (UPS/ARS) merchandise return label removed from the intermediate and the mailer of FIGS. 1 through 4.

When the mailer 70 is received by a customer, he or she tears along the perforation lines 26, 27 and along the lines 30, 31, 32 to open the mailer. Thus, the significant portions of the mailer 70 remaining are those portions of panel 18 between the lines 26, 31, 27, and those portions of the panel 19 between the lines 26, 30, 27. When the customer opens up the mailer 70, he or she sees the indicia 61 and the shipping label assembly 50. The user then grabs an edge of the merchandise return label 54, peels it off the release material 53 so that the adhesive 56 is exposed, and then—as illustrated in FIG. 5 applies the adhesive 56 to a package 71 so that the merchandise return label 54 sticks to the package 71 and the merchandise containing package 71 may be properly returned.

It will thus be seen that according to the present invention an intermediate and eccentric Z-fold mailer have been provided which allow the cost effective and quick sending of an ARS label to a customer, at a cost of at least a dollar (e.g. $1.25 U.S. 1997 dollars) less than the conventional technique, and with quicker turnaround time. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products, structures, and procedures.

What is claimed is:

1. An eccentric Z-fold mailer intermediate comprising:

a quadrate sheet of paper having first and second faces, top and bottom substantially parallel edges, and substantially parallel side edges substantially perpendicular to said top and bottom edges;

first and second fold lines substantially parallel to said top and bottom edges, and dividing said sheet of paper into first, second, and third panels, said first panel between said top edge and said first fold line, and said third panel between said bottom edge and said second fold line, and said second panel between said first and second panels, said second and third panels of substantially said same size and shape, and said first panel having a smaller length, along said side edges, than said second and third panels;

a blow on shipping label assembly disposed on said first face of said third panel;

a first series of patterns of adhesive disposed on said first face of said second and third panels for holding said first face of said second and third panels together when said sheet is folded about said second fold line; and a second series of patterns of adhesive disposed on said second face of said first and second panels for holding said second face of said first and second panels together when said sheet is folded about said first fold line.

2. An eccentric Z-fold mailer intermediate as recited in claim 1 wherein said blow on label assembly comprises a release liner permanently adhesively attached to said sheet, and a merchandise return label including merchandise label return tracking indicia on a first face thereof, and pressure sensitive adhesive on a second face thereof releasably attached to said release liner.

3. An eccentric Z-fold mailer intermediate as recited in claim 2 further comprising outgoing address indicia imaged on said first face of said first panel.

4. An eccentric Z-fold mailer intermediate as recited in claim 3 further comprising other indicia imaged on said first face of said second panel, said other indicia and said outgoing address indicia having said same orientation.

5. An eccentric Z-fold mailer intermediate as recited in claim 2 further comprising first and second lines of weakness parallel to and adjacent said side edges to define separable edge strips of said sheet, portions of said first and second series of said patterns of adhesive disposed in said separable margin strips.

6. An eccentric Z-fold mailer intermediate as recited in claim 5 wherein said first and second patterns of adhesive comprise pressure activated cohesive.

7. An eccentric Z-fold mailer intermediate as recited in claim 6 further comprising third and fourth lines of weakness parallel to and adjacent said bottom edge and said first fold line in said second panel, portions of said first pattern of adhesive disposed on said first face between said bottom edge and said third line of weakness, and between said first fold line and said third fold line.

8. An eccentric Z-fold mailer intermediate as recited in claim 3 further comprising return address indicia imaged on said second face of said second panel adjacent said second fold line and having said same orientation as said outgoing address indicia when said first panel is folded about said first fold line.

9. An eccentric Z-fold mailer intermediate as recited in claim 2 wherein said sheet side edges have a length of about 14 inches, and said sheet top and bottom edges have a length of about 8.5 inches, and said first panel side edges have a length of about three inches.

10. An eccentric Z-fold mailer intermediate as recited in claim 9 wherein said merchandise return label has dimensions of about 4.25 by 5.75 inches, and is spaced at least about 0.75 inches from each of said bottom edge and said second fold line.

11. An eccentric Z-fold mailer intermediate as recited in claim 1 wherein said first and second patterns of adhesive comprise pressure activated cohesive; and further comprising first and second lines of weakness parallel to and adjacent said side edges to define separable edge strips of said sheet, portions of said first and second series of said patterns of adhesive disposed in said separable edge strips.

12. An eccentric Z-fold mailer intermediate as recited in claim 11 further comprising third and fourth lines of weakness parallel to and adjacent said bottom edge and said first fold line in said second panel, portions of said first pattern of adhesive disposed on said first face between said bottom edge and said third line of weakness, and between said first fold line and said third fold line.

13. An eccentric Z-fold mailer comprising:

first, second, and third panels each having first and second faces, and disposed in a stack, said second panel sandwiched between said first and third panels so that said second face of said first panel engages said second face of said second panel, and said first face of said second panel engages said first face of said third panel;

said second and third panels having substantially the same size and shape, including aligned side edges having a first length;

said first panel having a second length significantly less than said first length;

outgoing address indicia imaged on said first face of said first panel and other indicia imaged on said first face of at least one of said second and third panels;

a blow on label assembly sandwiched between said second and third panels; and adhesive patterns connecting said second and third panel first faces together and said second faces of said first and second panels together.

14. An eccentric Z-fold mailer as recited in claim 13 wherein said adhesive patterns comprise pressure activated cohesive.

15. An eccentric Z-fold mailer as recited in claim 13 wherein said blow on label assembly comprises a release liner with permanent pressure sensitive adhesive on a first face thereof and a release material on a second face thereof, and a merchandise return label with merchandise return tracking indicia on a first face thereof, and pressure sensitive adhesive on a second face thereof engaging said release material.

16. An eccentric Z-fold mailer as recited in claim 15 wherein said release liner pressure sensitive adhesive is attached to said third panel first face, and said other indicia is on said second panel first face.

17. An eccentric Z-fold mailer as recited in claim 13 wherein said second and third panels each have side edges with a length of about 5.75 inches each, and wherein said first panel has side edges with a length of about 2.5 inches each.

18. An eccentric Z-fold mailer as recited in claim 15 wherein said second and third panels each have side edges with a length of about 5.75 inches each, and wherein said first panel has side edges with a length of about 2.5 inches each.

19. An eccentric Z-fold mailer as recited in claim 18 wherein said merchandise return label has dimensions of about 4.25 by 5.75 inches, and is spaced at least about 0.75 inches from both top and bottom edges thereof.

20. An eccentric Z-fold mailer as recited in claim 14 further comprising lines of weakness in said panels adjacent but spaced from said side edges thereof, pressure activated cohesive disposed between said lines of weakness and side edges.

* * * * *